US005479438A

United States Patent [19]

Blum et al.

[11] Patent Number: 5,479,438

[45] Date of Patent: Dec. 26, 1995

[54] APPARATUS FOR FUSING A SOLID LAYER OF ELECTRICALLY CONDUCTIVE MATERIAL

[75] Inventors: Mathias Blum, Alzenau; Alok Choudhury, Püttlingen; Hans-Günter Fellmann, Obertshausen; Wilfried Goy, Kelsterbach; Franz Hugo, Aschaffenburg; Felix Müller, Biebergmünd-Breitenborn; Wolfgang Schwarz, Linsengericht-Geislitz; Hardy Weisweiler, Hanau, all of Germany

[73] Assignee: Leybold Durferrit GmbH, Cologne, Germany

[21] Appl. No.: 264,726

[22] Filed: Jun. 23, 1994

[30] Foreign Application Priority Data

Jun. 23, 1993 [DE] Germany ..... 43 20 766.9

[51] Int. Cl.[6] ..... H05B 6/22

[52] U.S. Cl. ..... 373/156; 373/139; 373/142; 75/10.14

[58] Field of Search ..... 373/142, 151, 373/155, 156, 158, 22; 75/10.14, 10.18

[56] References Cited

U.S. PATENT DOCUMENTS

| | | | |
|---|---|---|---|
| 3,531,574 | 9/1970 | Sterling et al. | 373/158 |
| 4,432,093 | 2/1984 | Reboux | 373/157 |
| 4,723,996 | 2/1988 | Brunet et al. | 75/10.14 |
| 4,738,713 | 4/1988 | Stickle et al. | 75/10.18 |
| 4,762,553 | 8/1988 | Savage et al. | 75/0.5 C |
| 4,873,698 | 10/1989 | Boen | 373/156 |
| 4,923,508 | 5/1990 | Diehm et al. | 75/10.14 |
| 5,084,091 | 1/1992 | Yolton | 75/336 |
| 5,109,389 | 4/1992 | Stenzel | 373/156 |
| 5,272,718 | 12/1993 | Stenzel et al. | 373/22 |
| 5,280,496 | 1/1994 | Schlecht | 373/158 |
| 5,280,847 | 1/1994 | Blum et al. | 222/593 |

FOREIGN PATENT DOCUMENTS

| | | |
|---|---|---|
| 1615195 | 12/1970 | Germany . |
| 2011795 | 2/1972 | Germany . |
| 9013377 | 11/1990 | WIPO . |

*Primary Examiner*—Tu Hoang
*Attorney, Agent, or Firm*—Felfe & Lynch

[57] ABSTRACT

In a melting crucible (3) a central bottom portion (27) is formed of a plurality of palisades (5) and is shaped so that the palisades together form a vessel or a pot (7) having a centrally disposed spout or outlet (8). Two independently powered induction coils (10, 11) are provided, one coil (10) externally surrounding the collar or upper part of the central bottom portion (27), and the other coil (11) externally surrounding the spout (8). The palisades (5) are separated from one another by individual gaps (6) running radially outwardly from the center, while the electromagnetic field of at least the upper coil (10) acts on the charge contained in the melting crucible through the gaps (6).

2 Claims, 3 Drawing Sheets

APPARATUS FOR FUSING A SOLID LAYER OF ELECTRICALLY CONDUCTIVE MATERIAL

BACKGROUND OF THE INVENTION

The invention relates to an apparatus for fusing a solid layer of electrically conductive material and for producing a homogeneous molten stream running from a ceramic-free crucible.

U.S. Pat. No. 5,272,718 discloses a method for forming a molten stream by means of a funnel flanged to a larger melting tank in which the molten material is situated. The funnel is divided into liquid-cooled metal segments, and a coil supplied with alternating current surrounds the funnel and heats the melt in the funnel by induction. This known method produces a molten metal stream that will be as thin as possible while avoiding the risk of solidification.

U.S. Pat. No. 4,738,713 discloses a crucible for the ceramic-free melting of reactive metals or metal alloys, consisting of a plurality of water-cooled palisades of metal, which are all connected together electrically and form narrow gaps with one another. The crucible formed by the palisades is surrounded by an induction coil permitting the charge to be melted, and the crucible and coil are disposed in a vacuum tank. This cold crucible permits the slag-free fusion of reactive metals of high purity.

U.S. Pat. No. 5,084,091 discloses a slotted crucible of similar configuration for melting titanium particles. The crucible is provided with a bottom spout permitting the molten metal to flow out for the purpose of spraying it.

Lastly, U.S. Pat. No. 4,762,553 discloses a powder spraying apparatus for the purpose of levitation melting, charges on the order of 2 kg. The crucible is surrounded by a first induction coil and the bottom spout is held by a second coil serving to aim the stream; each coil is provided with its own power supply. A gas nozzle at the bottom end of the spout enables the molten metal to be atomized.

SUMMARY OF THE INVENTION

The apparatus of the present invention includes at least two controlled induction coils, and at least one liquid-cooled, slotted pot situated in range of the upper induction coil. The pot surrounds the charge and consists of electrically conductive material either entirely or at least within range of the depth of penetration of the electromagnetic field.

The apparatus makes it possible to control the input of energy into an electrically conductive charge so that the fusion of a starter does, a starter plate, and a skull can be performed, followed by melting a stopper plug in a pouring spout and the shaping of a pouring stream. The pouring stream is for this purpose to issue from the apparatus either parallel to the axis or at a selected angle. The apparatus is usable even for big charges up to several metric tons, and not just for amounts that can be controlled by a fully levitational melting process.

DETAILED DESCRIPTION OF THE PREFERRED EMBODIMENT

Figure 1:
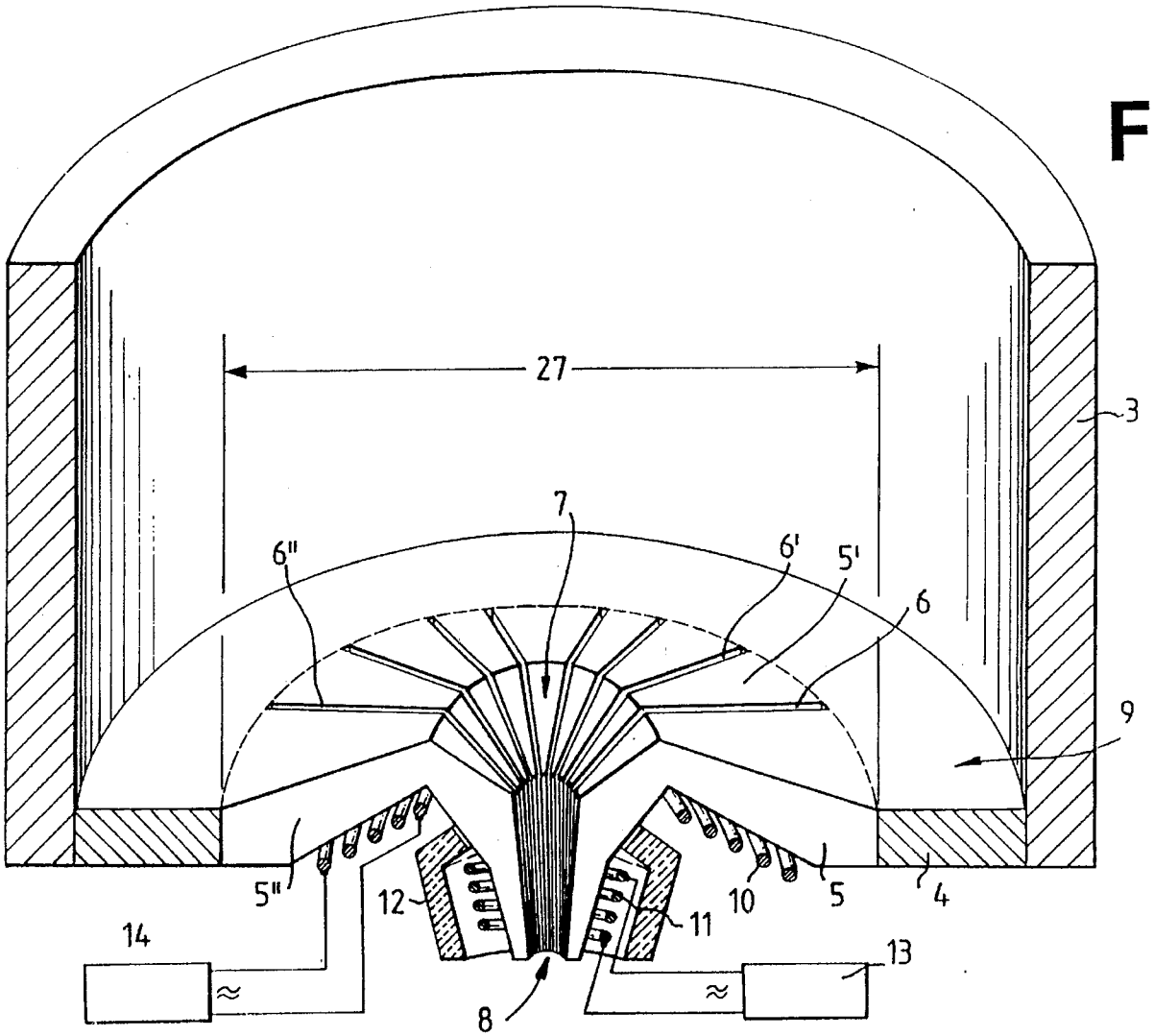
FIG. 1 is a diagrammatic sectional elevation view of a preferred embodiment.

Referring to FIG. 1, the substantially cylindrical crucible 3 forming the main melting unit is provided with an annular bottom portion 4 from which segment-like palisades 5 extend radially inward, separated from one another by narrow gaps running radially, and which together form a central part 27 of the bottom. The individual segment-like palisades 5 are shaped so that together they form a funnel-shaped entryway and vessel or pot 7 merging with a slightly tapering funnel or spout 8 for guiding the molten stream. The annular bottom portion 4 has a planar surface 9 while the palisades 5 have surfaces which slope upwardly toward the center, leading finally to the funnel or pot 7. The underside of the crucible 3 consists likewise of an annular, planar marginal portion and a first conical section in contact with a first induction coil 10, and this section adjoins a second conical section surrounding the spout 8, which is surrounded by a second induction coil 11 which in turn is surrounded by a ring 12 of magnetic material. The induction coil 10 is connected to a first power source 14, while the induction coil 11 is connected to a second power source 13. The power sources 13 and 14 must produce an electromagnetic field that is as uniform as possible. The bottom-most turn of the second induction coil 11 is advantageously provided with a downwardly directed pitch equalizing piece, as described in U.S. Pat. No. 5,280,847.

Figure 1A:
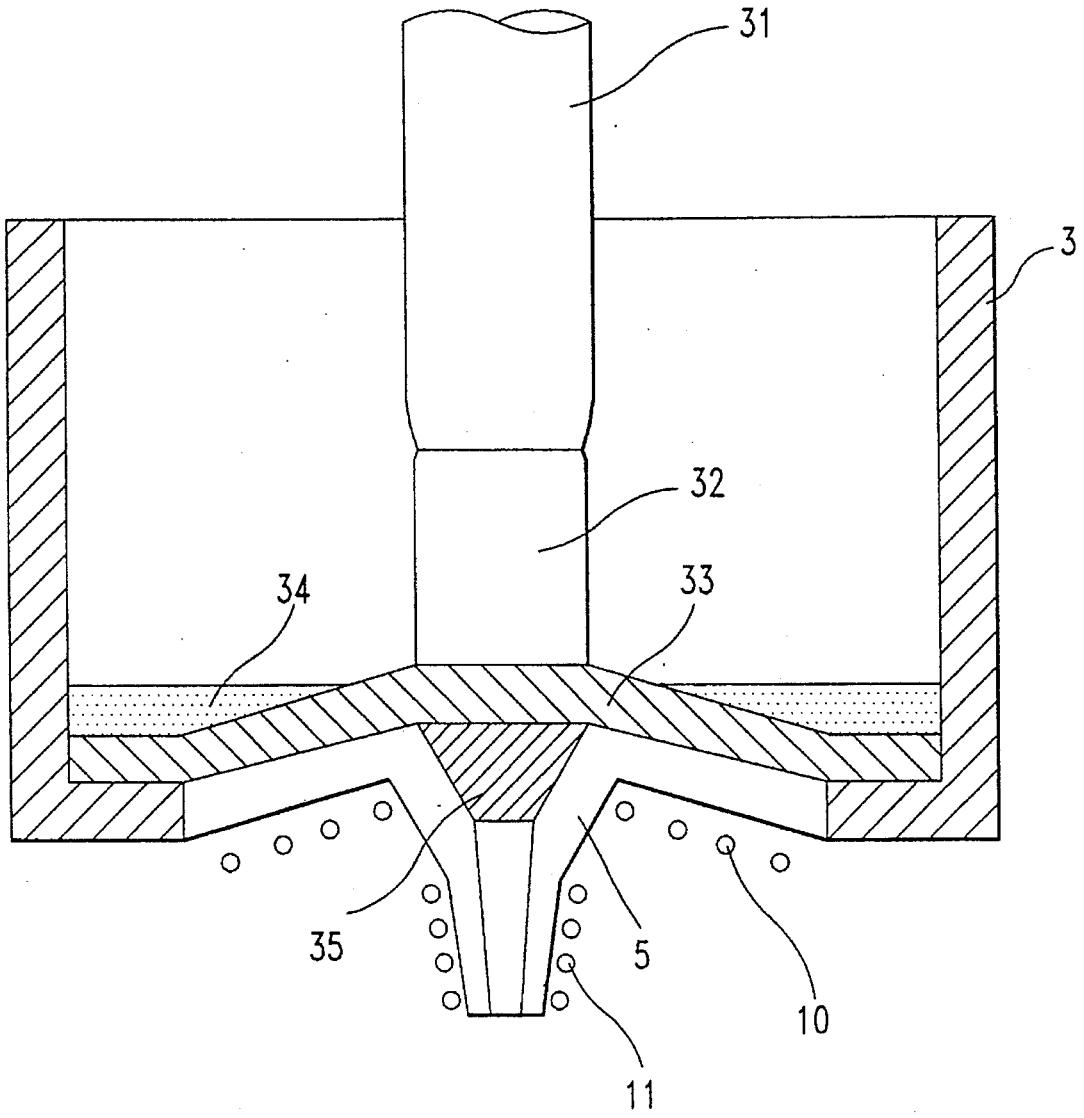
FIG. 1A is a cross sectional view of the crucible of FIG. 1 during start-up.

The start-up operation may be best understood with reference to the cross section of FIG. 1A, which illustrates a consumable electrode 31, a starter dose 32, a starter plate 33, a layer of slag 34, and a stopper plug 35 in the pouring spout. First, the electrode 31 burns through the starter dose and forms a central pouring hole in the starter plate. The induction coil 10 then melts the starter plate 33 to form a central funnel, followed by melting the plug 35 with lower coil 11. The starter plate 33 may be replaced by a skull of solidified metal from an earlier pouring procedure. Molten metal then flows from the spout in a stream whose temperature, size, and direction are regulated by coil 11. Metal is replenished by downward movement of the consumable electrode 31, while the surface of the melt outside the pouring zone is insulated by granulated non-meltable material 34 (slag).

Since the palisades 5 slope upward from the planar surface 9 toward the funnel 7, the molten bath is deepest toward the outer cylindrical wall of crucible 3. A zone of reduced flow forms in this area, so that inclusions of high density in the melt will settle here, improving uniformity of the cast metal.

The apparatus described can be combined with any of the ceramic-free crucibles and units in commercial use today, and makes it possible at a chosen moment in the process to initiate the pouring from the main melting unit by melting away an initially solid, electrically conductive layer.

In addition to affecting the pouring stream with the forces produced by the electromagnetic fields, the spout can be stopped or regulated by the additional construction even when the molten material has a great depth.

The above described management of the process calls for the use of the two separately controllable inductances 10 and 11 in order to satisfy the necessary frequency criteria and to be able to control the power distribution. The upper coil 10 operates at a frequency of less than 20 kHz while the lower coil 11 operates at frequencies above 20 kHz. In this manner the outlet temperature of the melt can be controlled.

To produce and sustain a uniform pouring stream it must be assured under all conditions of the process that no incrustation of dirt or other undesirable material will occur, or that such can be melted away.

For example, an operation or circumstances are conceivable in which it is necessary to be able to perform metallurgical operations without the discharge of molten metal, when in the meantime the spout 8 has been closed or interruptions have occurred in the principal melting unit 3. To be able to resume the pouring, the spout 8 must be melted open again, before the process of pouring from the main melting unit 3 can be continued.

The apparatus may be used with main melting units whose charge weight amounts to several tons, precluding levitation of the entire melt.

Figure 2:
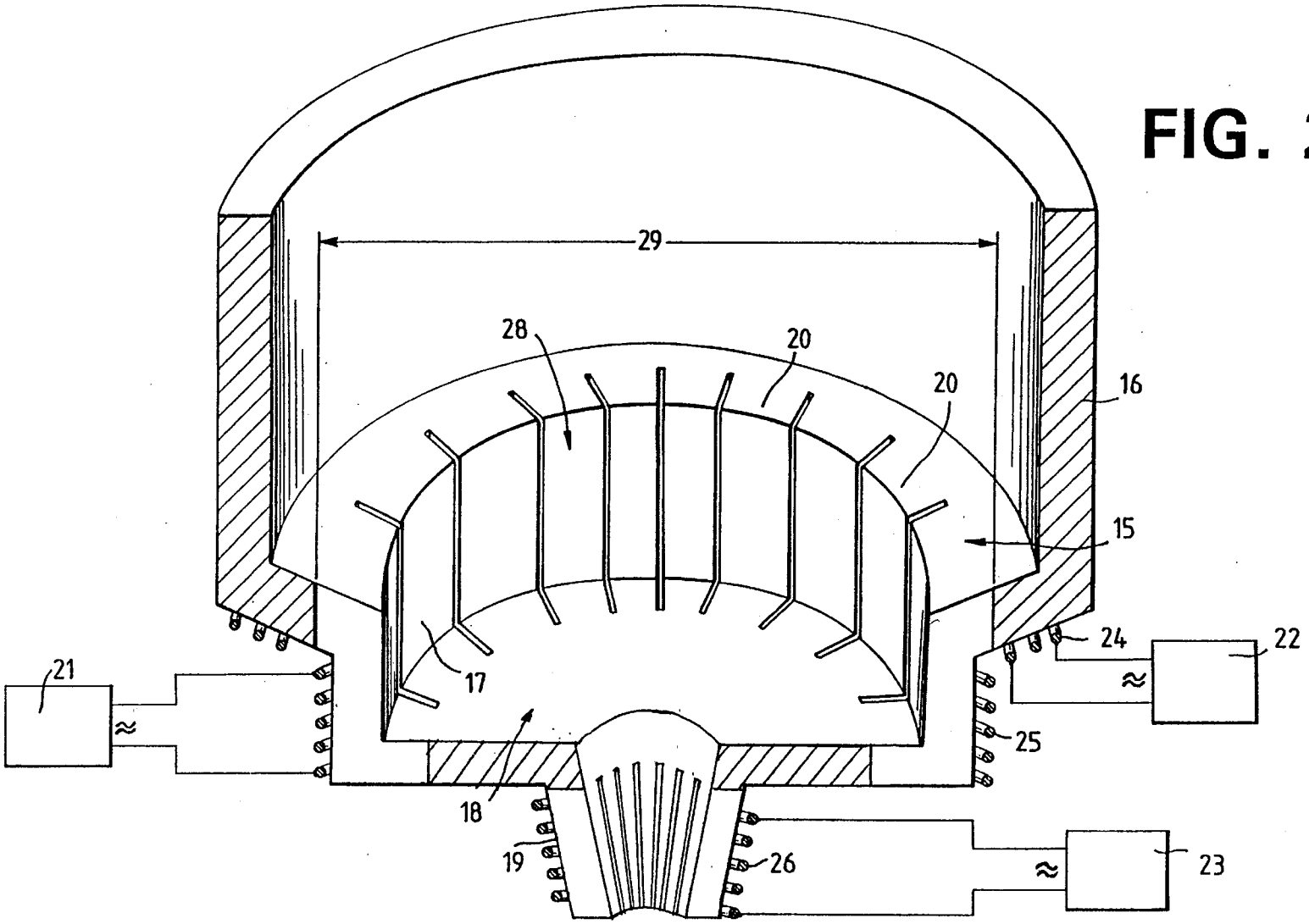
FIG. 2 is a diagrammatic sectional elevation view of an alternative embodiment.

In the embodiment represented in FIG. 2, the bottom surface 15 of the main crucible 16 is funnel-shaped in the marginal area, and this funnel-shaped part 15 merges toward the middle of cylindrical part 17 which in turn is adjoined by a planar bottom part 18, while the pouring opening or funnel 19 is located in the middle of this bottom part 18. The cylindrical portion 17 is made in a slotted form, i.e., it is composed of individual palisades 20. In contrast to the embodiment in FIG. 1, in the embodiment of FIG. 2 a total of three power supply units 21, 22, 23, are provided for three induction coils 24, 25 and 26, all of which can be activated independently. The pot 28 formed essentially by the palisades 20 has a cylindrical shape in which the individual gaps 30 permit the passage of the electromagnetic field of coil 25 without significant formation of eddy currents. The upper coils 24 and 25 are operated at frequencies of less than 20 kHz, and serve to melt the closure plate or skull and keep it molten during casting. The lower coil 26 is operated above 20 kHz, and not only melts the stopper but forces the teeming stream away from the cooled copper palisades to reduce heat losses. The coil 26 can also be used to modulate the direction of the stream.

In the embodiment of FIG. 2 the floor 18 does not have slots extending continuously therethrough. In an alternative embodiment (not shown) it is possible for slots to extend continuously from cylindrical portion 17 through the floor 18 to the funnel 19.

We claim:

1. Apparatus for melting a solid layer of electrically conductive material and for producing a uniform molten stream of metal, said apparatus comprising a ceramic free crucible comprising an annular bottom portion and palisades extending continuously radially inward to form a pot portion and a central spout, said palisades being separated by radial gaps and having surfaces which extend upward from said annular bottom portion to said pot portion, then downward in said pot portion to said central spout, a first induction coil surrounding said pot portion and a controlled by a first RF power supply, and a second induction coil surrounding said central spout and controlled by a second RF power supply.

2. Apparatus as in claim 1 wherein said first induction coil is located directly below said palisades, between said annular bottom portion and said pot portion.

* * * * *